US006826804B2

(12) United States Patent
Zaidman

(10) Patent No.: US 6,826,804 B2
(45) Date of Patent: Dec. 7, 2004

(54) FURNITURE HANDLE

(75) Inventor: S Paul Zaidman, Winnipeg (CA)

(73) Assignee: Palliser Furniture Ltd., Winnipeg (CA)

( * ) Notice: Subject to any disclaimer, the term of this patent is extended or adjusted under 35 U.S.C. 154(b) by 0 days.

(21) Appl. No.: 10/232,966

(22) Filed: Aug. 30, 2002

(65) Prior Publication Data

US 2004/0040120 A1 Mar. 4, 2004

(51) Int. Cl.[7] ..... A45C 13/26; B25G 1/04

(52) U.S. Cl. ..... 16/436; 16/430; 16/DIG. 19

(58) Field of Search ..... 16/436, 430, 431, 16/114.1, 412, 415, 416, DIG. 18, DIG. 19; 126/25 R; 30/339, 340; 312/214, 244, 320; 81/489, 436, 177.1, DIG. 5; 74/551.9, 543, 553; 190/117, 115; 220/762, 772, 767, 770, 776

(56) References Cited

U.S. PATENT DOCUMENTS

| | | | | | |
|---|---|---|---|---|---|
| 2,125,783 | A | * | 8/1938 | Heeman | 292/347 |
| 2,329,767 | A | * | 9/1943 | Jakeway | 16/419 |
| 2,355,978 | A | * | 8/1944 | Keeler | 16/412 |
| 2,407,763 | A | * | 9/1946 | North et al. | 16/419 |
| 3,500,973 | A | * | 3/1970 | Bush | 16/114.1 |
| 3,754,319 | A | * | 8/1973 | Miori | 29/509 |
| 3,969,009 | A | | 7/1976 | Radek | 312/320 |
| 4,087,141 | A | * | 5/1978 | Roberts | 312/348.6 |
| 4,134,198 | A | | 1/1979 | Briggs | 29/450 |
| 4,280,247 | A | | 7/1981 | Burzen et al. | 16/112 |
| 4,291,998 | A | | 9/1981 | Santos | 402/263 |
| 4,340,990 | A | * | 7/1982 | Seynhaeve | 16/445 |
| 4,364,150 | A | | 12/1982 | Remington | 16/126 |
| 4,645,235 | A | * | 2/1987 | Joseph | 280/821 |
| 4,862,553 | A | | 9/1989 | Festoso et al. | 16/124 |
| 5,046,652 | A | | 9/1991 | Shanok et al. | 224/326 |
| 5,083,357 | A | | 1/1992 | Noguchi et al. | 29/430 |
| 5,152,561 | A | | 10/1992 | Engebretson | 292/145 |
| 5,322,278 | A | | 6/1994 | Jeanrot | 273/73 |
| 5,412,839 | A | * | 5/1995 | McCollom | 16/430 |
| 5,475,896 | A | | 12/1995 | Wang | 16/111 |
| 5,528,795 | A | | 6/1996 | Gramegna | 16/112 |
| 5,651,575 | A | | 7/1997 | Bystrom et al. | 294/171 |
| 5,797,813 | A | | 8/1998 | Huang | 473/549 |
| 5,857,241 | A | | 1/1999 | Camp, Jr. et al. | 16/111 |
| 5,993,470 | A | | 11/1999 | Yoon | 606/185 |
| 6,082,771 | A | | 7/2000 | Long et al. | 281/37 |
| 6,108,870 | A | * | 8/2000 | Lo | 16/431 |
| 6,119,309 | A | | 9/2000 | Lu | 16/114.1 |
| 6,167,592 | B1 | | 1/2001 | Tsai | 16/411 |
| 6,290,040 | B1 | | 9/2001 | Chen | 190/39 |
| 6,349,450 | B1 | | 2/2002 | Koops et al. | 16/412 |
| 6,397,478 | B1 | | 6/2002 | Bornancini | 30/232 |
| 6,421,880 | B1 | | 7/2002 | Prajapati et al. | 16/431 |
| 6,421,882 | B1 | | 7/2002 | Liao et al. | 16/445 |
| 6,581,247 | B1 | * | 6/2003 | Yu Chen | 16/430 |

FOREIGN PATENT DOCUMENTS

| | | | |
|---|---|---|---|
| WO | WO 96/38068 | * | 12/1996 |
| WO | 0882635 A1 | * | 12/1998 |
| WO | 2001-275751 | * | 10/2001 |
| WO | WO 01/96088 A1 | * | 12/2001 |

* cited by examiner

*Primary Examiner*—Chuck Y. Mah
(74) *Attorney, Agent, or Firm*—Clifford W. Browning; Woodard, Emhardt, Moriarty, McNett & Henry LLP

(57) ABSTRACT

A furniture handle comprises a frame having a frame wall defining a cavity. The frame has at least one protrusion opening extending from the cavity through the frame wall. An insert is adapted to be retained within the cavity. The insert has a protrusion extending through the at least one protrusion, opening beyond the frame wall. Preferably the cavity has an insert opening accessible from outside of said frame, such that the insert can be placed into and removed from the cavity. Preferably the insert is made from one of a polymer gel, neoprene, rubber, latex rubber, suitable PVC and polyurethane foams, and styrene or polystyrene.

30 Claims, 4 Drawing Sheets

FURNITURE HANDLE

FIELD OF THE INVENTION

The present invention relates to furniture handles and the like.

BACKGROUND

There are various known types of handles that are used on furniture. These handles are typically used for assisting in the opening and closing of certain parts of pieces of furniture such as doors to cupboards, or drawers. The handles can be integrally formed with the furniture part or be a separate component that is attached thereto.

It is known to employ various types of decorative features to make handles more pleasing to the eye. For example, handles can be ornamented by being shaped in a particular way and by selecting a particular material to make the handle (e.g. brass, aluminum, or a particular type of wood).

Although the handle must be rigid, there is usually not a significant load-bearing requirement for handles used for furniture. Additionally, unlike handles for luggage, the comfort of the user when operating the handle has not previously been a primary consideration for the design of furniture handles. In this regard, users sometime experience an unpleasant sensation when grasping handles made from some kinds of material, particularly metals which often feel cold to the touch. This unpleasant feel of metal handles, is often noticed by children.

U.S. Pat. No. 4,862,553 to Festoso et al. illustrates a handle for furniture that has an elongated body with a slot in its front that can removably receive a colored decorator strip. It will be noted however that in the Festoso et al. patent, there is no reference to a particular material, from which the decorator strip is made. Additionally, the decorator strip only provides an ornamental feature.

SUMMARY OF INVENTION

The inventive handle satisfies the functionality requirement of providing a device with which a piece of furniture such as a door or drawer can be moved. It also provides a visually pleasing device and at the same time, the inventive handle provides for a physical interaction with the handle during use that is pleasing in a tactile manner, particularly to children who have, furniture employed in their immediate surroundings (like their bedrooms).

According to one aspect of the present invention, there is provided a furniture handle comprising: a) frame having a frame wall defining a cavity, said frame having at least one protrusion opening extending from said cavity through said frame wall; b) an insert adapted to be retained within said cavity, said insert having a protrusion extending through said at least one protrusion opening beyond said frame wall.

According to another aspect of the present invention, there is provided a kit comprising: a) frame having a frame wall defining a cavity, said frame having at least one protrusion opening extending from said cavity through said frame wall; b) a plurality of inserts, each of said plurality of inserts adapted to be retained within said cavity, each of said inserts having a protrusion extending through said at least one protrusion opening beyond said frame wall.

According to another aspect of the present invention, there is provided a furniture handle comprising: a) a frame having a frame wall having at least one protrusion opening extending through said frame wall; b) an insert made from a resilient material and having a protrusion extending through said at least one protrusion opening beyond said frame wall, said insert being secured to said frame at least in part by friction fit of said protrusion through said protrusion opening.

According to another aspect of the present invention, there is provided a furniture handle comprising: a) a frame made from a rigid material having a frame wall with a front face and a rear face, said frame wall and having at least one protrusion opening extending from said rear face through said frame wall to said front face; b) an insert made from a material comprising one of polymer gel, neoprene, rubber, latex rubber, suitable PVC and polyurethane foams, and styrene or polystyrene, said insert being secured at a rear face of said frame and said insert having a protrusion, extending through said at least one protrusion opening beyond said frame wall, said insert being secured to said frame at least in part by friction fit of said protrusion through said protrusion opening.

According to another aspect of the present invention, there is provided a piece of furniture having a furniture part connected to a furniture handle, said furniture handle comprising: a) a frame made from a rigid material having a frame wall with a front face and a rear face, said frame wall and having at least one protrusion opening extending from said rear face through said frame wall to said front face; b) an insert made from a material comprising one of polymer gel, neoprene, rubber, latex rubber, suitable PVC and polyurethane foams, and styrene or polystyrene, said insert being secured at a rear face of said frame and said insert having a protrusion extending through said at least one protrusion opening beyond said frame wall, said insert being secured to said frame at least in part by friction fit of said protrusion through said protrusion opening.

BRIEF DESCRIPTION OF DRAWINGS

In figures which illustrate by way of example only, an embodiment of the invention.

DETAILED DESCRIPTION

Figure 1:
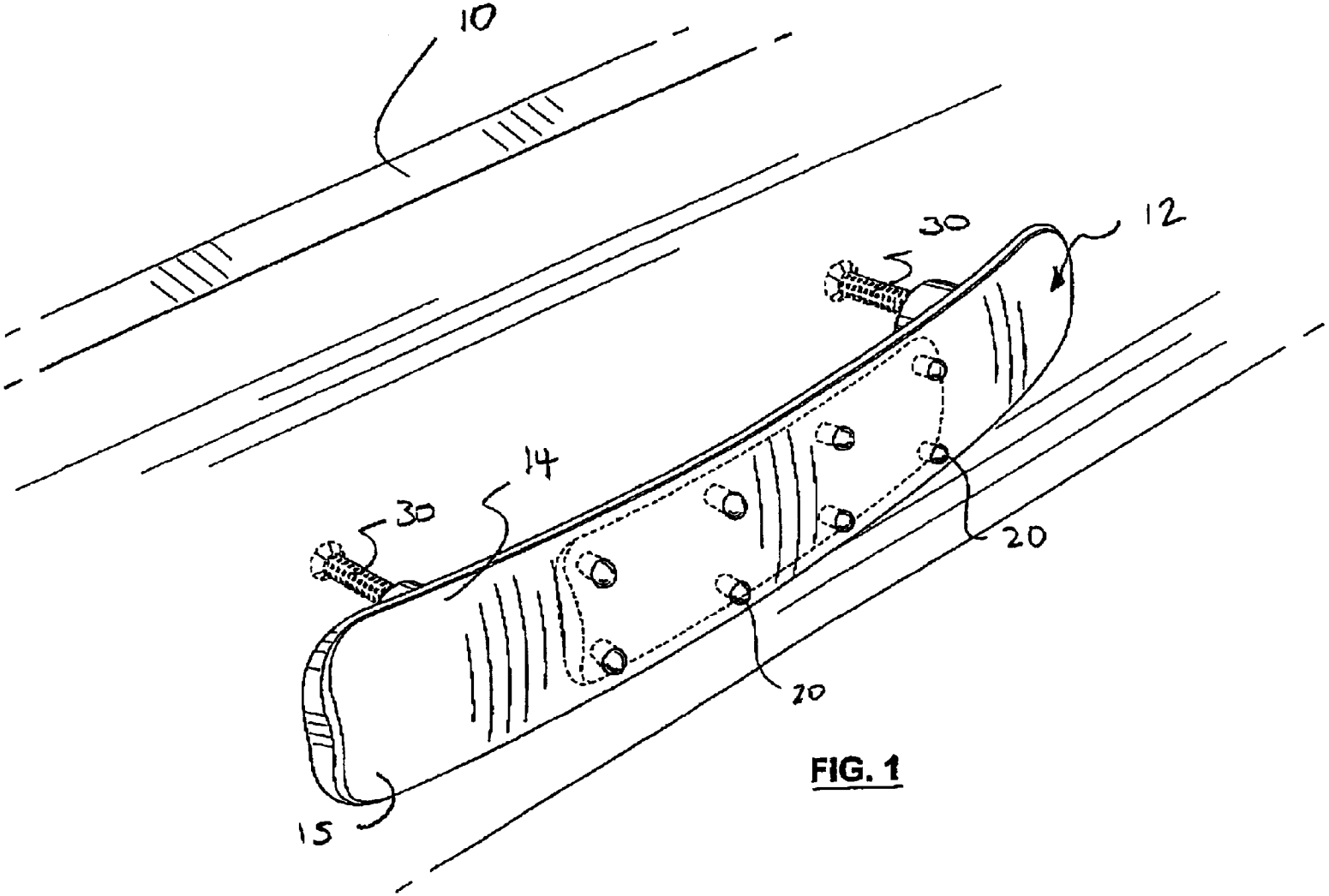
FIG. 1 is a front perspective view of a handle attached to a piece of furniture in accordance with an embodiment of the invention.

With reference to the figures, a handle generally designated 12 is secured with screws 30 to a part 10 of a piece of furniture. Typically, furniture part 10 will be a drawer, a door, or the like but handle 12 is not restricted to use in such applications, and can be used elsewhere in connection with furniture.

Handle 12 includes a frame 14 having a front face 15 and a rear face 17. Frame 14 is preferably formed from a relatively rigid and strong material such as a metal like cast iron, zinc, steel, or can be made from a rigid plastic or a wood or composite wood material. Rear face 17 has a cavity 28 formed therein. Cavity 28 has side-walls 28*a*, 28*b*, 28*c* and 28*d* and a rear wall 28*e*. Side walls 28*a*–28*d* assist in retaining an insert member 16 in cavity 28.

Secured to rear face 17 are protruding collars 24 having rear facing openings 26 leading to threaded cavities for receiving screws 30. In this way, handle 12 can be secured with screws 30 to furniture part 10. Of course other known attachment devices and methods can be employed to attach handle 12 to furniture part 10, such as with adhesives, etc. However, it is preferable that main body portion 18 of handle 12 is positioned away from the front face of the furniture part 10. In this way, even when attached to furniture part 10, cavity 28 is accessible for insertion or replacement of an insert 16.

Additionally, when a person grasps the handle to operate it, their hand will come into contact with the insert 16, held in cavity 28, and the contact with the frame body will be minimized.

Insert 16 is preferably made from a material which has one or more of the following qualities: (1) it is soft to a person's touch; (2) it is relatively warm to a person's touch (compared to a metal); (3) it is relatively flexible; and (4) it has some degree of resiliency.

Preferably, insert 16 is made from a natural or synthetic polymer that is relatively easy for a person at least partially to deform, and yet is resilient. In other words, preferably insert 16 is not made from a rigid material but has spring-like mechanical characteristics. The preferred product is a suitable polymer gel, having the characteristics of being relatively soft to the touch and yet having some degree of flexibility and resiliency. Examples of other preferred materials include neoprene, rubber, latex rubber, suitable PVC and polyurethane foams, and styrene or polystyrene. Other materials that can be formed by injection molding can be used.

Although in some embodiments, the materials used to make insert 16 can be rigid and have no resiliency, in such embodiments an independent attachment mechanism may be required. For example, insert 16 could be glued into cavity 28.

It is preferred that the inserts have some part, that is compressed to fit into the cavity and/or have its protrusions compressed to fit through apertures 22 to frame 14. In this way a frictional fit Is formed between (1) the protrusions and the walls of the apertures and/or (2) the side-walls 28*a*–28*d* of cavity 28 and the corresponding walls of insert 16.

Preferably, when inserted into cavity 28, insert 16's outer face 19 is substantially flush with face 17 of frame 14. It is intended that inserts in a variety of colors, each like insert 16, be available, so that the portion of the insert which is visible from the front of the handle (in this case the protrusions 20 through apertures 22) can be chosen for desirable ornamental results.

Figure 2:
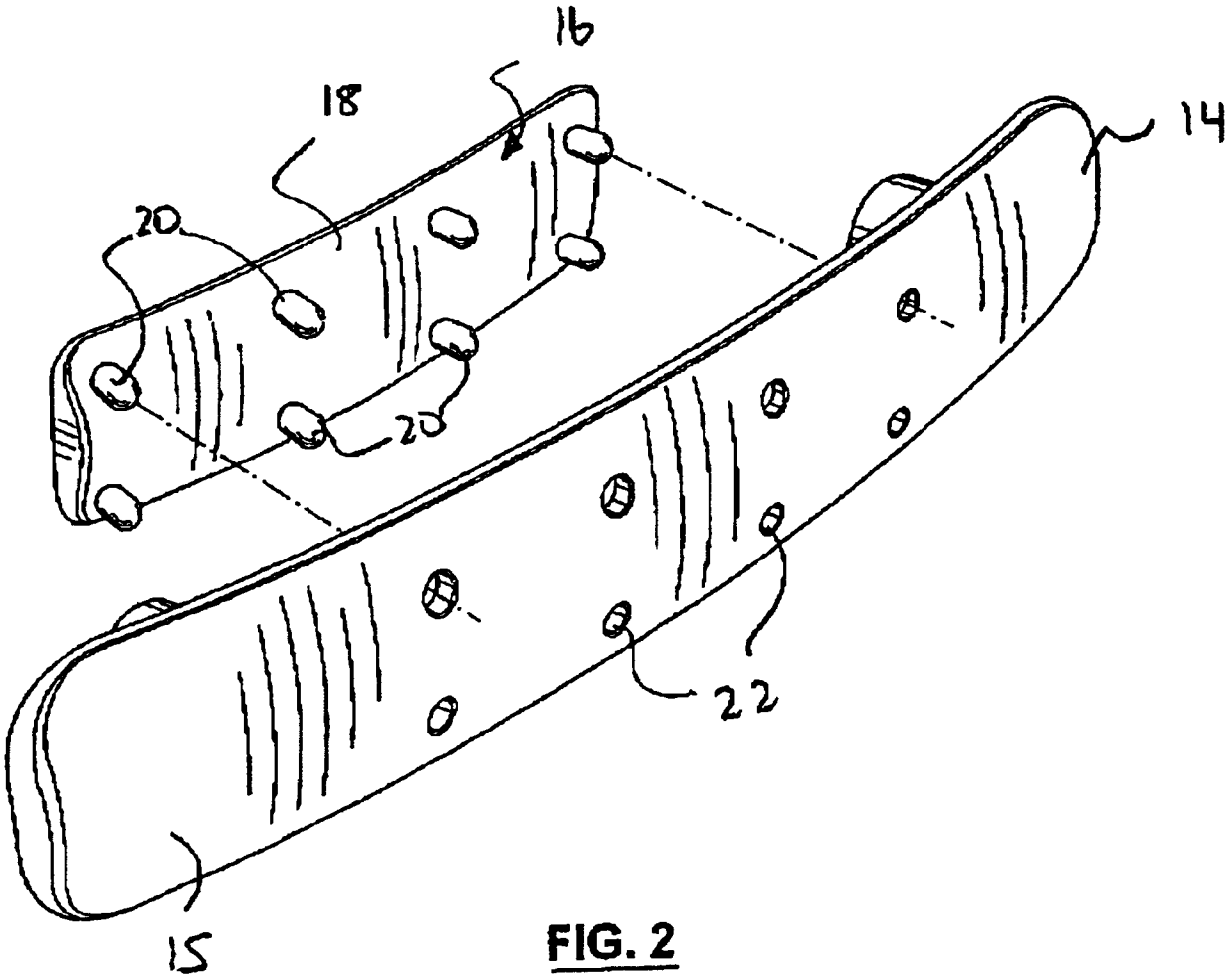
FIG. 2 is a front, perspective view of the handle of FIG. 1 with a part removed.
Figure 3:
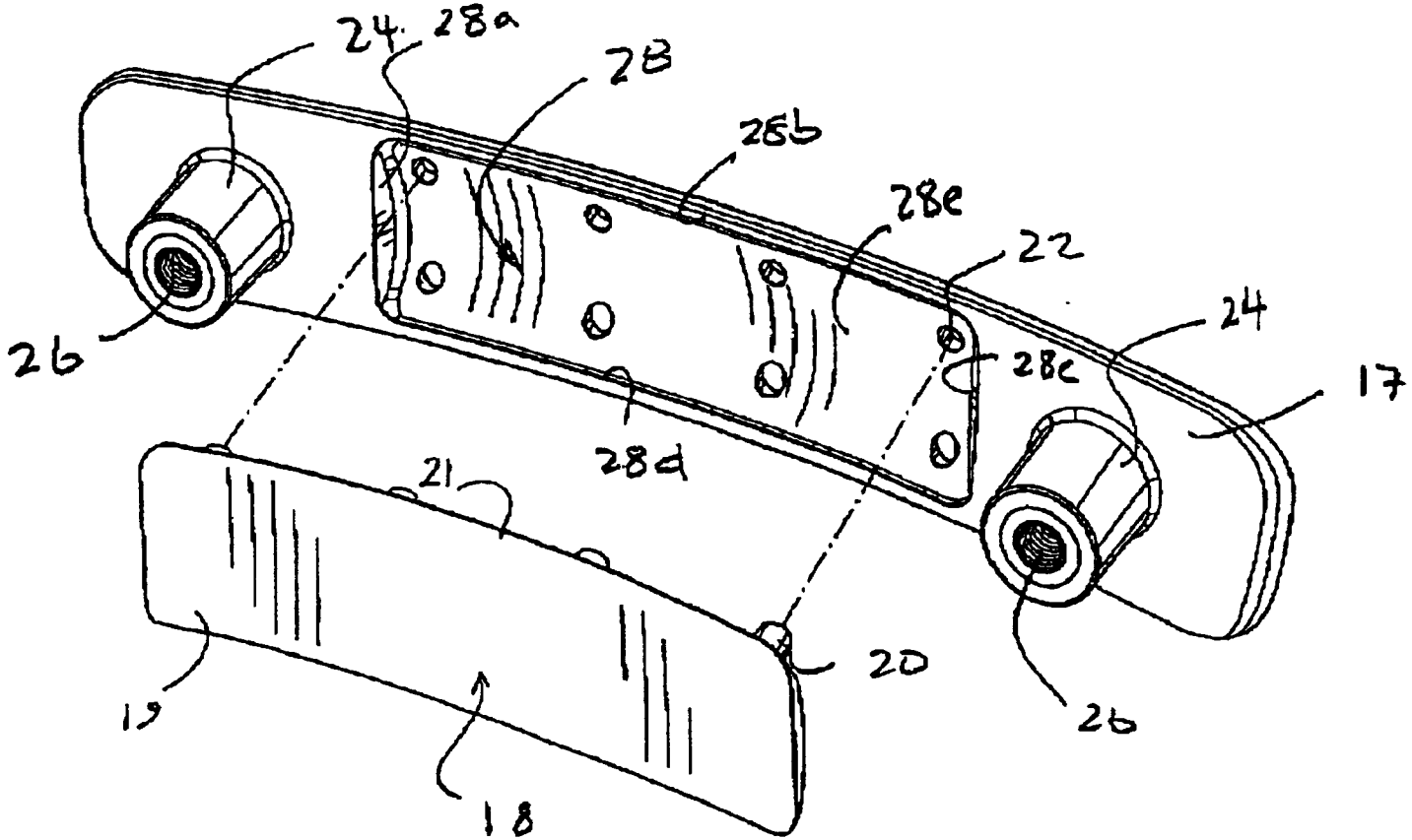
FIG. 3 is a rear exploded perspective view of the handle of FIG. 1 with a part removed.
Figure 4:
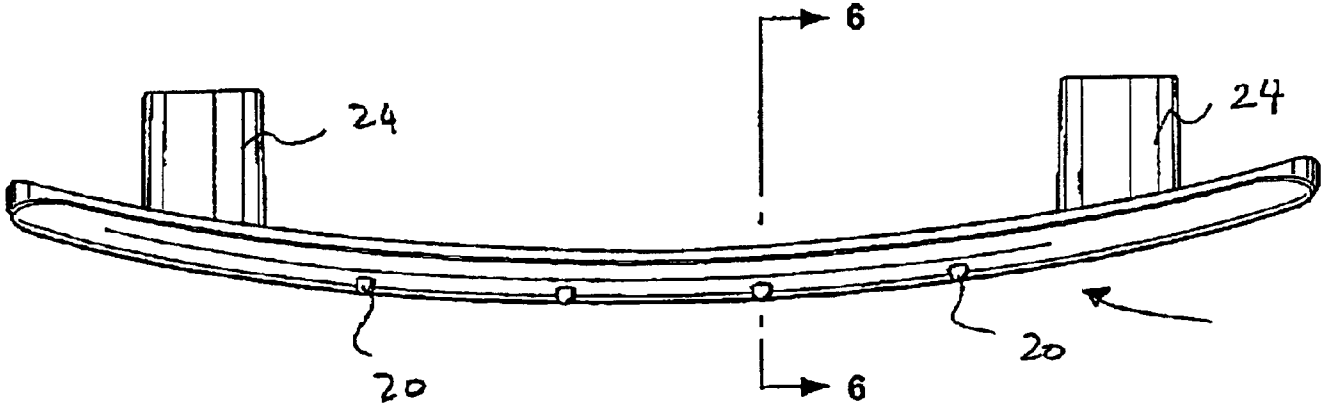
FIG. 4 is a top plan view of the handle of FIG. 1.
Figure 6:
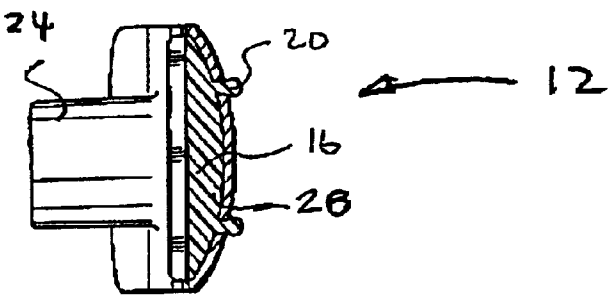
FIG. 6 is a cross-sectional elevation view at 6—6 in FIG. 4.
Figure 5:
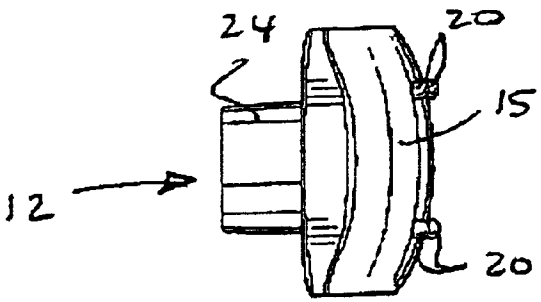
FIG. 5 is a side elevation view of the handle of FIG. 1.

Protrusions 20 are preferably cylindrical in shape with semi-spherical ends, as best illustrated in FIG. 2. However the protrusions can be formed in a limitless variety of shapes such as for example, with circular, square, triangular cross sectional shapes. Insert 16, could be broken into two or more separate inserts that can be combined together in cavity 28. Each insert could be made from a different material and/or different colour.

It will be appreciated that by providing a plurality of protrusions of one or more particular colors, a pleasing decorative effect can be achieved which is not overbearing in relation to the color of the frame, and indeed the rest of the piece of furniture.

The openings 22 and their corresponding protrusions can also be arranged in an infinite variety of patterns, instead of a 2-hole by 4-hole arrangement as is illustrated herein.

Aside from the decorative functionality of handle 12, the presence of protrusions 20 extending through apertures 18 above front face 15, provides users with tactile sensations when touched. Children in particular will enjoy the tactile sensation resulting from contacting protrusions 20 with their hands, when operating handle 12.

The tactile sensation is enhanced particularly when protrusions 20 are formed from an easily deformable, semi-rigid material like, a polymer gel or rubber.

The presence of insert 16 at the rear face of handle 12 also provides the user of the handle with a more pleasing feeling when operating the handle, by grasping the rear of the handle when for example opening a drawer. The user's hand will in this way not come into contact for example, with a cold metal frame.

The handle could be provided to a consumer as a kit comprising a frame along with several inserts each made from a different material and/or of different colors, so the consumer can choose which insert to use.

Additionally, inserts can be changed to alter the appearance. In the preferred embodiment, this can be done without having to detach the handle 12 from furniture part 10.

Various other embodiments are contemplated within the scope of the invention as defined by the claims hereinafter.

I claim:

1. A furniture handle comprising:

a) a frame having a frame wall defining a cavity, said frame wall having at least one protrusion opening extending from said cavity defining a cavity opening through said frame wall;

b) an insert adapted to be retained within said cavity, said insert having a protrusion extending through said at least one protrusion opening beyond said frame wall; and c) an attachment mechanism configured to attach said frame to a generally planar surface of a piece of furniture.

2. A handle as claimed in claim 1 wherein said cavity has an insert opening accessible from outside of said frame, such that said insert can be placed into and removed from said cavity.

3. A handle as claimed in claim 2 wherein said frame has a front face and a rear face and said cavity opening is in said rear face and said protrusion opening extends through said front face.

4. A handle as claimed in claim 1 wherein said insert has a plurality of protrusions and wherein said at least one protrusion opening comprises a plurality of protrusion openings, each of said plurality of protrusions extending from said cavity through said frame wall beyond said frame wall.

5. A handle as claimed in claim 4 wherein said frame has a front face and a rear face and said cavity opening is in said rear face and said plurality of protrusions extend beyond said front face.

6. A handle as claimed in claim 1 wherein said insert is retained in said cavity by a friction fit between said insert and said frame.

7. A handle as claimed in claim 6 wherein said frame is made from a rigid material and said insert is made from a semi-rigid material.

8. A handle as claimed in claim 7 wherein said insert is made from a resilient material.

9. A handle as claimed in claim 8 wherein the insert is made from one of a polymer gel, neoprene, rubber, latex rubber, suitable PVC and polyurethane foams, and styrene or polystyrene.

10. A handle as claimed in claim 8 wherein the insert is made from a polymer gel.

11. A kit comprising:

a) a frame having a frame wall defining a cavity, said frame having at least one protrusion opening extending from said cavity defining a cavity opening through said frame wall;

b) a plurality of inserts, each of said plurality of inserts adapted to be retained within said cavity, each of said inserts having a protrusion extending through said at least one protrusion opening beyond said frame wall.

12. A kit as claimed in claim 11 wherein said cavity has an insert opening accessible from outside of said frame, such that an insert of said plurality of said inserts can be placed into said cavity.

13. A kit as claimed in claim 11 wherein said frame has a front face and a rear face and said cavity opening is in said rear face and said protrusion opening extends through said front face.

14. A kit as claimed in claim 12 wherein said insert has a plurality of protrusions and wherein said at least one protrusion opening comprises a plurality of protrusion openings, each of said plurality of protrusions extending from said cavity through said frame wall beyond said frame wall.

15. A furniture handle comprising:

a) a frame having a frame wall having at least one protrusion opening extending through said frame wall;

b) an insert made from a resilient material and having a protrusion extending through said at least one protrusion opening beyond said frame wall, said insert being secured to said frame at least in part by friction fit of said protrusion through said protrusion opening.

16. A handle as claimed in claim 15 wherein the insert is made from a polymer gel.

17. A handle as claimed in claim 16 wherein said frame is made from a metal.

18. A handle as claimed in claim 15 wherein the insert is made from one of a polymer gel, neoprene, rubber, latex rubber, suitable PVC and polyurethane foams, and styrene or polystyrene.

19. A furniture handle comprising:

a) a frame made from a rigid material having a frame wall with a front face and a rear face, said frame wall having at least one protrusion opening extending from said rear face through said frame wall to said front face; and b) an insert made from a material comprising one of a polymer gel, neoprene, rubber, latex rubber, suitable PVC and polyurethane foams, and styrene or polystyrene, said insert being secured at a rear face of said frame and said insert having a protrusion extending through said at least one protrusion opening beyond said frame wall, said insert being secured to said frame at least in part by friction fit of said protrusion through said protrusion opening.

20. A handle as claimed in claim 19 wherein the insert is made from a polymer gel.

21. A handle as claimed in claim 20 wherein said frame is made from a metal.

22. A piece of furniture having a furniture part connected to a furniture handle, said furniture handle comprising:

a) a frame made from a rigid material having a frame wall with a front face and a rear face, said frame wall having at least one protrusion opening extending from said rear face through said frame wall to said front face; and b) an insert made from a material comprising one of a polymer gel, neoprene, rubber, latex rubber, suitable PVC and polyurethane foams, and styrene or polystyrene, said insert being secured at a rear face of said frame and said insert having a protrusion extending through said at least one protrusion opening beyond said frame wall, said insert being secured to said frame at least in part by friction fit of said protrusion through said protrusion opening.

23. A piece of furniture as claimed in claim 22 wherein the insert is made from a polymer gel.

24. A piece of furniture as claimed in claim 23 wherein said frame is made from a metal.

25. A piece of furniture having a furniture part connected to a furniture handle, said furniture handle comprising:

a) a frame having a frame wall defining a cavity, said frame wall having at least one protrusion opening extending from said cavity through said frame wall; and b) an insert adapted to be retained within said cavity, said insert having a protrusion extending through said at least one protrusion opening beyond said frame wall;

and wherein said furniture piece further comprises an attachment mechanism for attaching said handle to said furniture part.

26. A piece of furniture as claimed in claim 25 wherein said attachment mechanism is adapted for attaching said handle to a planar surface of said furniture part.

27. A piece of furniture as claimed in claim 25 wherein the insert is made from a polymer gel.

28. A piece of furniture as claimed in claim 26 wherein said frame is made from a metal.

29. A piece of furniture as claimed in claim 25 wherein the insert is made from one of a polymer gel, neoprene, rubber, latex rubber, suitable PVC and polyurethane foams, and styrene or polystyrene.

30. A handle comprising:

a) a frame having a frame wall defining a cavity, said frame wall having at least one protrusion opening extending from said cavity through said frame wall; and b) an insert adapted to be retained within said cavity, said insert having a protrusion extending through said at least one protrusion opening beyond said frame wall;

wherein said insert is retained in said cavity by a friction fit between said insert and said frame.

* * * * *